US009709019B2

(12) United States Patent
Ikeda

(10) Patent No.: US 9,709,019 B2
(45) Date of Patent: Jul. 18, 2017

(54) PLASMA GENERATION DEVICE AND INTERNAL COMBUSTION ENGINE

(75) Inventor: Yuji Ikeda, Kobe (JP)

(73) Assignee: IMAGINEERING, INC., Hyogo (JP)

( * ) Notice: Subject to any disclaimer, the term of this patent is extended or adjusted under 35 U.S.C. 154(b) by 317 days.

(21) Appl. No.: 13/980,480

(22) PCT Filed: Jan. 14, 2012

(86) PCT No.: PCT/JP2012/050642

§ 371 (c)(1),
(2), (4) Date: Oct. 3, 2013

(87) PCT Pub. No.: WO2012/099027

PCT Pub. Date: Jul. 26, 2012

(65) Prior Publication Data

US 2014/0026839 A1 Jan. 30, 2014

(30) Foreign Application Priority Data

Jan. 18, 2011 (JP) ..... 2011-007939

(51) Int. Cl.
*F02P 23/04* (2006.01)
*H05H 1/46* (2006.01)
(Continued)

(52) U.S. Cl.
CPC ..... *F02P 23/04* (2013.01); *F02P 9/007* (2013.01); *F02P 15/04* (2013.01); *F02P 15/08* (2013.01);
(Continued)

(58) Field of Classification Search
CPC . F02M 27/04; F02P 13/00; F02P 15/04; F02P 23/04; F02P 23/045; F02P 3/02; F02P 15/08; F02P 9/007; F02B 23/101
(Continued)

(56) References Cited

U.S. PATENT DOCUMENTS 8,240,293 B2 8/2012 Ikeda
2003/0010307 A1* 1/2003 Truglio ..... F02P 15/04 123/162
(Continued)

FOREIGN PATENT DOCUMENTS

EP 2178350 A1 4/2010
EP 2264306 A1 12/2010
(Continued)

OTHER PUBLICATIONS

International Search Report of PCT/JP2012/050642, mailing date of May 29, 2012.
(Continued)

*Primary Examiner* — Hung Q Nguyen
*Assistant Examiner* — Xiao Mo
(74) *Attorney, Agent, or Firm* — Westerman, Hattori, Daniels & Adrian, LLP

(57) ABSTRACT

In a plasma generation device that generates electromagnetic wave plasma by emitting electromagnetic waves in a target space, the electromagnetic wave plasma is generated in a plurality of locations with a simple configuration and relatively low electromagnetic wave energy. The plasma generation device is provided with an antenna that emits electromagnetic waves supplied from an electromagnetic wave generator in the target space, a discharger that forcibly discharges free electrons from gas molecules in the target space, and an electric field concentration member that concentrates electric field of the electromagnetic wave emitted from the antenna. The electric field concentration member is arranged in non-contact relationship with the antenna. The plasma generation device causes the discharger to discharge free electrons and the antenna to emit electromagnetic waves, thereby generating electromagnetic wave plasma in
(Continued)

the vicinity of the antenna and in the vicinity of the electric field concentration member.

11 Claims, 5 Drawing Sheets

(51) Int. Cl.
*F02P 9/00* (2006.01)
*F02P 15/04* (2006.01)
*F02P 15/08* (2006.01)
*F02P 3/02* (2006.01)

(52) U.S. Cl.
CPC ..... *F02P 23/045* (2013.01); *H05H 1/46* (2013.01); *F02P 3/02* (2013.01); *H05H 2001/4652* (2013.01); *H05H 2245/1215* (2013.01)

(58) Field of Classification Search
USPC ..... 123/143 B, 536, 310, 305, 162
See application file for complete search history.

(56) References Cited

U.S. PATENT DOCUMENTS

2007/0209634 A1* 9/2007 Minami ..... F02P 5/00 123/310
2009/0229581 A1 9/2009 Ikeda
2010/0012083 A1* 1/2010 Tanaka ..... F02B 23/101 123/305
2010/0186670 A1 7/2010 Ikeda
2010/0319656 A1* 12/2010 Clarke ..... B32B 27/04 123/310
2011/0030660 A1* 2/2011 Ikeda ..... F02B 1/02 123/536

FOREIGN PATENT DOCUMENTS

JP 2006-132518 A 5/2006
JP 2007-113570 A 5/2007
JP 2008-082286 A 4/2008
JP 2009-038025 A 2/2009
JP 2009-221947 A 10/2009
JP 2009221947 A * 10/2009
JP 2011-134636 A 7/2011
WO 2008/035448 A1 3/2008
WO 2009/008517 A1 1/2009
WO 2009/113692 A1 9/2009

OTHER PUBLICATIONS

Written Opinion of PCT/JP2012/050642, mailing date of May 29, 2012.

* cited by examiner

PLASMA GENERATION DEVICE AND INTERNAL COMBUSTION ENGINE

TECHNICAL FIELD

The present invention relates to a plasma generation device that generates electromagnetic wave plasma by emitting electromagnetic waves in a target space, and an internal combustion engine provided with the plasma generation device.

BACKGROUND ART

Conventionally, there is known a plasma generation device that generates electromagnetic wave plasma by emitting electromagnetic waves in a target space. For example, Japanese Unexamined Patent Application, Publication No. 2009-38025 and Japanese Unexamined Patent Application, Publication No. 2006-132518 disclose plasma generation devices of this kind.

More particularly, Japanese Unexamined Patent Application, Publication No. 2009-8025 discloses a plasma enhancement device that generates a spark discharge at a discharge gap of a spark plug and emits microwaves toward the discharge gap at the same time. In the plasma enhancement device, plasma generated by the spark discharge receives energy from microwave pulses. As a result of this, electrons in a region of the plasma are accelerated, ionization is promoted, and the plasma increases in volume.

Also, Japanese Unexamined Patent Application, Publication No. 2006-132518 discloses an ignition device of an internal combustion engine that generates plasma discharge by emitting electromagnetic waves in a combustion chamber from an electromagnetic radiator. On a top surface of a piston, an ignition electrode is provided, insulated from the piston. The ignition electrode serves a role to locally enhance electric field intensity of the electromagnetic wave in the vicinity thereof in the combustion chamber. The plasma discharge is generated in the vicinity of the ignition electrode. In the example shown in FIG. 3 of Japanese Unexamined Patent Application, Publication No. 2006-13251, a plurality of ignition electrodes are provided. In this case, it becomes possible to generate plasma discharges in a plurality of locations.

THE DISCLOSURE OF THE INVENTION

Problems to be Solved by the Invention

The plasma generation device disclosed by Japanese Unexamined Patent Application, Publication No. 2009-38025 supplies free electrons by means of an electron discharge unit that forcibly discharges free electrons, and accelerates the free electrons by way of electromagnetic wave energy, thereby generating electromagnetic wave plasma. By forcibly discharging the free electrons that cause the electromagnetic wave plasma, it is possible to reduce the electromagnetic wave energy, in comparison with a case in which electromagnetic wave alone is employed to generate the electromagnetic wave plasma. However, the electromagnetic wave plasma is generated only in a single location. As with the case of the plasma generation device disclosed by Japanese Unexamined Patent Application, Publication No. 2006-132518, a plurality of sets of electron discharge units and antennae would be required to generate the electromagnetic wave plasma in a plurality of locations.

The present invention has been made in view of the above described circumstances, and it is an object of the present invention to generate electromagnetic wave plasma in a plurality of locations with a simple configuration and relatively low electromagnetic wave energy in a plasma generation device that generates electromagnetic wave plasma by emitting electromagnetic waves in a target space.

Means for Solving the Problems

In accordance with a first aspect of the present invention, there is provided a plasma generation device including: an electromagnetic wave generator that generates electromagnetic waves; an antenna that emits in a target space the electromagnetic waves supplied from the electromagnetic wave generator; an electron discharge unit that forcibly discharges free electrons in the target space; and an electric field concentration member arranged in non-contact relationship with the antenna in the target space so as to concentrate the electric field of the electromagnetic waves emitted from the antenna; wherein the electron discharge unit forcibly discharges free electrons and the antenna emits electromagnetic waves, thereby generating electromagnetic wave plasma in the vicinity of the antenna and in the vicinity of the electric field concentration member.

According to the first aspect of the present invention, the electron discharge unit discharges free electrons. Meanwhile, the antenna emits electromagnetic waves to form a strong electric field, which is relatively strong in intensity in the target space, in the vicinity of the antenna. In the vicinity of the antenna, the free electrons discharged by the electron discharge unit receive electromagnetic wave energy and are effectively accelerated. The accelerated free electrons collide with ambient gas molecules. The collision gas molecules are ionized to form plasma. Also, free electrons in the plasma receive electromagnetic wave energy, are accelerated, and collide with ambient gas molecules to form plasma. In this manner, an avalanche-like generation of plasma occurs in the vicinity of the antenna, and relatively large electromagnetic wave plasma is generated.

The inventor of the present invention, as a result of experiments using a plasma generation device shown in FIG. 1, discovered that it is possible to generate electromagnetic wave plasma in a plurality of locations by arranging electric field concentration members 40, which concentrate electric field of the electromagnetic waves emitted from an antenna 36, in a target space 51. The strong electric fields are generated not only in the vicinity of the antenna but also in the vicinity of the electric field concentration members. The electric field concentration members locally increase electric field intensity of the electromagnetic waves. A part of the free electrons discharged by the electron discharge unit is effectively accelerated due to the strong electric field in the vicinity of the electric field concentration members 40. As a result of this, electromagnetic wave plasma is generated in the vicinity of the electric field concentration members 40 as well. According to the first aspect of the present invention, since electric field concentration members 40 are provided so that strong electric fields are formed in a plurality of locations, electromagnetic wave plasma is formed in a plurality of locations.

In accordance with a second aspect of the present invention, in addition to the first aspect of the present invention, the electric field concentration members are provided in plural so as to surround the antenna.

According to the second aspect of the present invention, the electric field concentration members are provided in plural so as to surround the antenna.

In accordance with a third aspect of the present invention, in addition to the first or second aspects of the present invention, the plasma generation device is configured to be switchable between a first state, in which the electromagnetic wave plasma is generated in the vicinity of the antenna and in the vicinity of the electric field concentration members, and a second state, in which the electromagnetic wave plasma is generated only in the vicinity of the antenna by lowering the electromagnetic waves generated by the electromagnetic wave generator in energy per unit time in comparison with the first state.

According to the third aspect of the present invention, it is possible to switch between a first state, in which the electromagnetic wave plasma is generated in a plurality of locations, and a second state, in which the electromagnetic wave plasma is generated in a single location.

In accordance with a fourth aspect of the present invention, there is provided an internal combustion engine, including: a plasma generation device according to any one of the first to third aspects of the present invention; and an internal combustion engine main body formed with a combustion chamber; wherein the combustion chamber constitutes the target space in which the plasma generation device generates the electromagnetic wave plasma.

According to the fourth aspect of the present invention, an antenna and electric field concentration members are arranged in the combustion chamber to generate the electromagnetic wave plasma in the vicinity of the antenna and in the vicinity of the electric field concentration members.

In accordance with a fifth aspect of the present invention, in addition to the fourth aspect of the present invention, the plasma generation device is provided with an injector that includes a plurality of injection holes adapted to inject fuel toward directions different from one another and injects fuel into the combustion chamber; wherein the electric field concentration members are provided in plural corresponding to the plurality of injection holes of the injector, and arranged at locations respectively corresponding to the injection holes.

According to the fifth aspect of the present invention, the electric field concentration members are provided in plural corresponding to the plurality of injection holes of the injector, and arranged at locations respectively corresponding to the injection holes. Therefore, electromagnetic wave plasma is formed in locations respectively corresponding to the injection holes of the injector.

Effects of the Invention

According to the present invention, since the electric field concentration members are provided so that strong electric fields, which have relatively strong electric field intensity in the target space, are formed in a plurality of locations, electromagnetic wave plasma is generated in a plurality of locations. It is possible to generate electromagnetic wave plasma in a plurality of locations by means of a single antenna, while eliminating the need for installing a plurality of sets of dischargers and antennae. Therefore, it is possible to simplify electromagnetic wave transmission system and the like in comparison with a case in which antennae are provided in plural.

Furthermore, according to the present invention, free electrons are supplied by the electron discharge unit and accelerated by electromagnetic wave energy, thereby generating electromagnetic wave plasma. The electron discharge unit supplies the free electrons that cause the electromagnetic wave plasma. Therefore, it is possible to generate the electromagnetic wave plasma in a plurality of locations using electromagnetic waves of low energy in comparison to a case in which the electromagnetic wave alone is employed to generate the electromagnetic wave plasma.

BEST MODE FOP CARRYING OUT THE INVENTION

In the following, a detailed description will be given of embodiments of the present invention with reference to drawings. It should be noted that the following embodiments are merely preferable examples, and do not limit the scope of the present invention, applied field thereof, or application thereof.

First Embodiment

Figure 1:
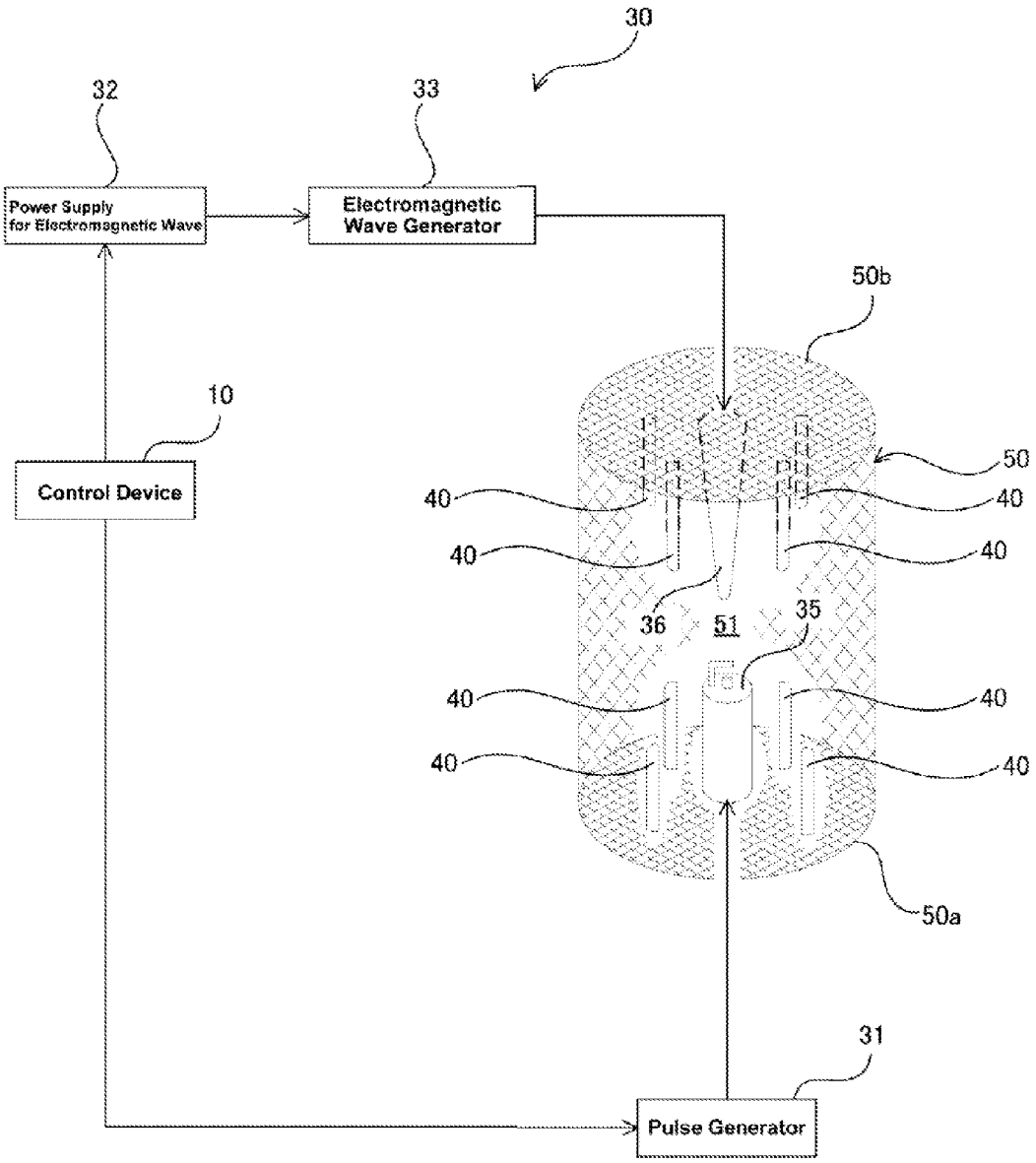
FIG. 1 is a schematic configuration diagram of a plasma generation device according to a first embodiment.

The first embodiment is directed to a plasma generation device 30 according to the present invention. As shown in FIG. 1, the plasma generation device 30 is provided with a pulse generator 31, a discharger 35, a power supply for electromagnetic wave 32, an electromagnetic wave generator 33, an antenna 36, and a control device 10.

The plasma generation device 30 is arranged for a reaction chamber 51 (constituting the target space) formed by a reaction chamber forming member 50. In the reaction chamber 51, chemical reactions such as toxic gas decomposition are carried out. The reaction chamber forming member 50 is a cylinder-shaped mesh member closed on both sides, and configured so as to prevent the electromagnetic wave emitted from the antenna 36 to the reaction chamber 51 from transmitting therethrough outwardly.

The pulse generator 31 is connected to a direct current power supply (not shown). The pulse generator 31 may be, for example, an ignition coil. The pulse generator 31, upon receiving a discharge signal from the control device 10, boosts a voltage applied from the direct current power supply, and outputs the boosted high voltage pulse to the discharger 35.

The discharger 35 constitutes an electron discharge unit that forcibly discharges free electrons in the reaction cha mer 51. The discharger 35 forcibly discharges free electrons by ionizing gas in the reaction chamber 51. The discharger 35 may be, for example, a spark plug. The discharger 35 includes a discharge electrode that is electrically connected to the pulse generator 31, and a ground electrode that forms a discharge gap with the discharge electrode. In the discharger 35, the discharge gap is located within the reaction chamber 51. As shown in FIG. 1, the discharger 35 is provided at the center of a side surface 50*a* (bottom surface) of the reaction chamber forming member 50.

The power supply for electromagnetic wave 32 is connected to the direct current power supply. The power supply for electromagnetic wave 32, upon receiving an electromagnetic wave generation signal (TTL signal, for example) from the control device 10, outputs a pulse current to the electromagnetic wave generator 33 for a predetermined time interval at a predetermined duty cycle.

The electromagnetic wave generator 33 may be, for example, a magnetron or a semiconductor oscillator. The electromagnetic wave generator 33 is electrically connected to the power supply for electromagnetic wave 32. The electromagnetic wave generator 33, upon receiving the pulse current, outputs a microwave pulse to the antenna 36.

The antenna 36 is electrically connected to the electromagnetic wave generator 33. The antenna 36 may be a rod-shaped monopole antenna. As shown in FIG. 1, the antenna 36 is provided at a center of the other side surface 50*b* (top surface) of the reaction chamber forming member 50. A tip end of the antenna 36 faces toward a tip end of the discharger 35. The antenna 36 is adapted to emit the microwave pulse supplied from the electromagnetic wave generator 33.

In the first embodiment, the plasma generation device 30 includes electric field concentration members 40 that are made of metal and designed to concentrate electric field of the microwave emitted from the antenna 36. The electric field concentration members 40 are provided in plural (eight pieces in the present embodiment). The bottom surface 50*a* and the top surface 50*b* of the reaction chamber forming member 50 are respectively provided with a plurality of the electric field concentration members 40.

Each electric field concentration member 40 is arranged so as not to contact with the antenna 36. Each electric field concentration member 40 protrudes from the bottom surface 50*a* or the top surface 50*b* toward inside of the reaction chamber 51. Each electric field concentration member 40 extends in an axial direction of the reaction chamber forming member 50.

On the bottom surface 50*a*, a plurality of the electric field concentration members 40 are arranged equiangularly and equidistantly from the discharger 35 so as to surround the discharger 35. The plurality of the electric field concentration members 40 are joined to the bottom surface 50*a* approximately at respective midpoints between the center and the outer circumference of the bottom surface 50*a*.

On the top surface 50*b*, a plurality of the electric field concentration members 40 are arranged equiangularly and equidistantly from the antenna 36 so as to surround the antenna 36. The plurality of the electric field concentration members 40 are joined to the top surface 50*b* approximately at respective midpoints between the center and the outer circumference of the top surface 50*b*.

<Operation of Plasma Generation Device>

The following description is directed to a plasma generation operation of the plasma generation device 30. In the plasma generation operation, the discharger 35 ionizes gas in the reaction chamber 51, and the antenna 36 simultaneously emits microwaves, thereby generating microwave plasma in the vicinity of the antenna 36 and in the vicinity of the electric field concentration members 40.

More particularly, in the plasma generation operation, the control device 10 firstly outputs a discharge signal and an electromagnetic wave generation signal approximately at the same time. More strictly, the control device 10 outputs the electromagnetic wave generation signal slightly before the discharge signal.

The power supply for electromagnetic wave 32, upon receiving the electromagnetic wave generation signal, outputs a pulse current for a predetermined time interval at a predetermined duty cycle. The electromagnetic wave generator 33 outputs a microwave pulse for the time interval at the predetermined duty cycle. The antenna 36 emits to the reaction chamber 51 the microwave pulse outputted from the electromagnetic wave generator 33. Meanwhile, the pulse generator 31, upon receiving the discharge signal, outputs a high voltage pulse. The discharger 35, upon receiving the high voltage pulse from the pulse generator 31, causes a spark discharge at the discharge gap.

In the plasma generation operation, a start timing of the microwave pulse emission to the reaction chamber 51 is prior to the spark discharge, and an end timing of the microwave pulse emission to the reaction chamber 51 is after the spark discharge. The spark discharge occurs within a time period of the microwave pulse emission. During the time period of the microwave pulse emission, strong electric fields, which have relatively strong electric field intensity in the reaction chamber 51, are formed respectively in the vicinity of the antenna 36 and in the vicinity of the electric field concentration members 40. In the strong electric fields, electrons emitted from gas molecules due to the spark discharge are accelerated while receiving the microwave energy. The accelerated electrons collide with ambient gas molecules. The collision gas molecules are ionized to form plasma. Also, electrons in the plasma are accelerated while receiving the microwave energy, and collide with ambient gas molecules to form plasma. In this manner, an avalanche-like generation of plasma occurs in the vicinity of the antenna 36 and in the vicinity of the electric field concentration members 40, and relatively large microwave plasma is generated.

When a predetermined time interval has elapsed after a rise time of the electromagnetic wave generation signal, the microwave pulse generation is terminated, and the microwave plasma disappears.

A start timing of the microwave pulse emission to the reaction chamber 51 may be after the spark discharge as long as the microwave pulse is emitted before discharge plasma generated by the spark discharge disappears.

Effect of First Embodiment

In the first embodiment, since the electric field concentration members 40 are arranged so that strong electric fields, which have relatively strong electric field intensity, are formed in a plurality of locations, the microwave plasma is generated in a plurality of locations. It is possible to generate the microwave plasma in a plurality of locations by means of a single pair of discharger 95 and antenna 36 while eliminating the need for installing a plurality of sets of dischargers 35 and antennae 36. Therefore, it is possible to simplify a transmission system and the like in comparison with a case in which a plurality of sets of dischargers 35 and antennae 36 are provided.

Furthermore, in the first embodiment, free electrons are supplied by the discharger 35 and accelerated by the microwave energy, thereby generating the microwave plasma. The discharger 35 supplies the free electrons that cause the microwave plasma. Therefore, it is possible to generate the microwave plasma in a plurality of locations using microwave of low energy in comparison with a case in which the microwave alone is employed to generate the microwave plasma.

Modified Example of First Embodiment

Figure 2:
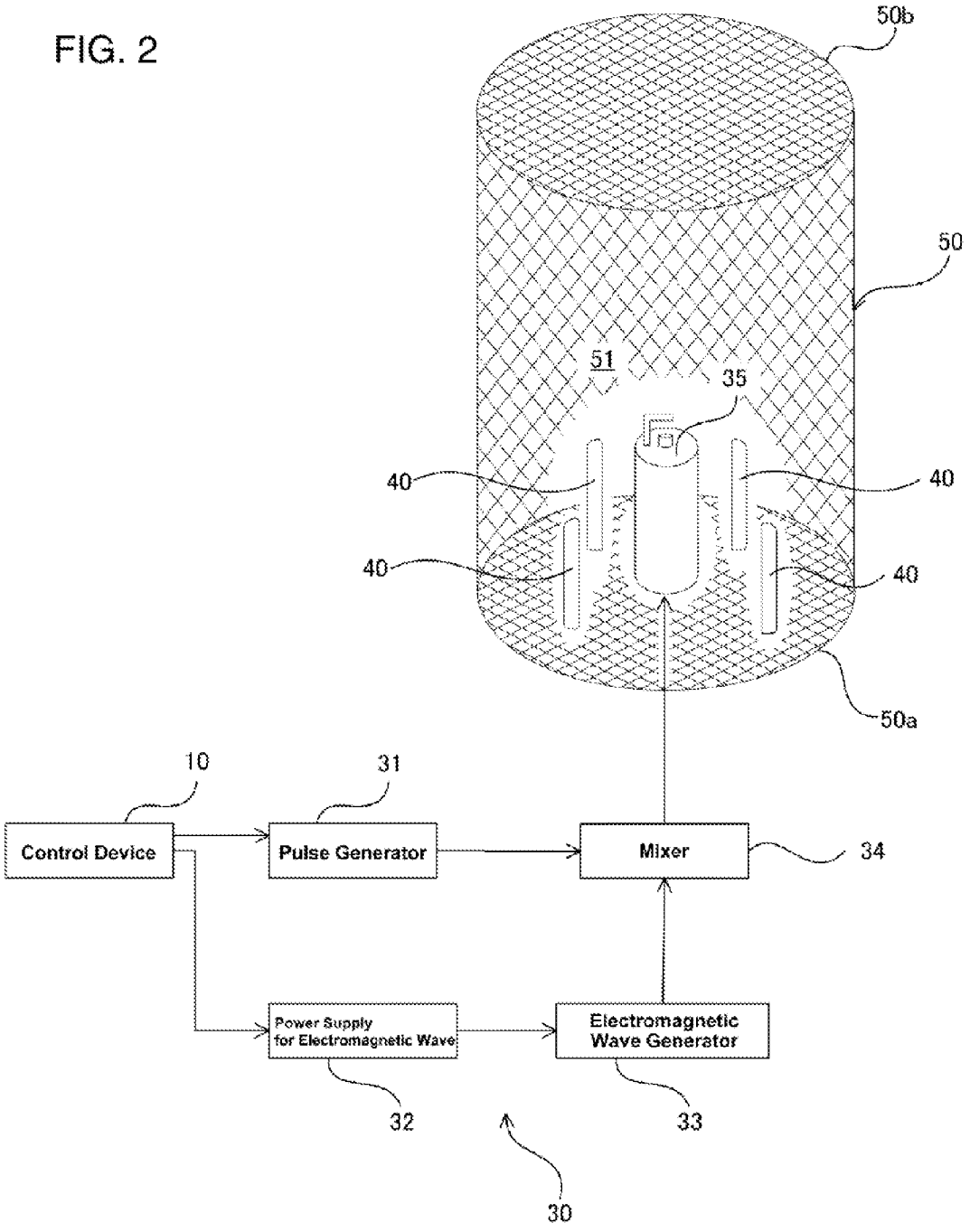
FIG. 2 is a schematic configuration diagram of a plasma generation device according to a modified example of the first embodiment.

In a modified example of the first embodiment, the discharge electrode of the discharger 35 functions as an antenna for microwave. As shown in FIG. 2, the plasma generation device 30 is provided with a pulse generator 31, a power supply for electromagnetic wave 32, an electromagnetic wave generator 33, a mixer 34, a discharger 35, and a control device 10.

The mixer 34 mixes a high voltage pulse outputted from the pulse generator 31 and a microwave pulse outputted from the electromagnetic wave generator 33, and outputs the mixed pulse to the discharger 35. The discharger 35, upon receiving the high voltage pulse and the microwave pulse from the mixer 34, causes a spark discharge at a discharge gap, and emits microwaves from a discharge electrode.

During a time period of the microwave pulse emission, strong electric fields, which have relatively strong electric field intensity in the reaction chamber 51, are formed in the vicinity of a tip end of the discharge electrode and in the vicinity of a tip end of the electric field concentration members 40. Therefore, similarly to the first embodiment, the microwave plasma is generated in the vicinity of the antenna 36 and in the vicinity of the electric field concentration members 40.

Second Embodiment

Figure 3:
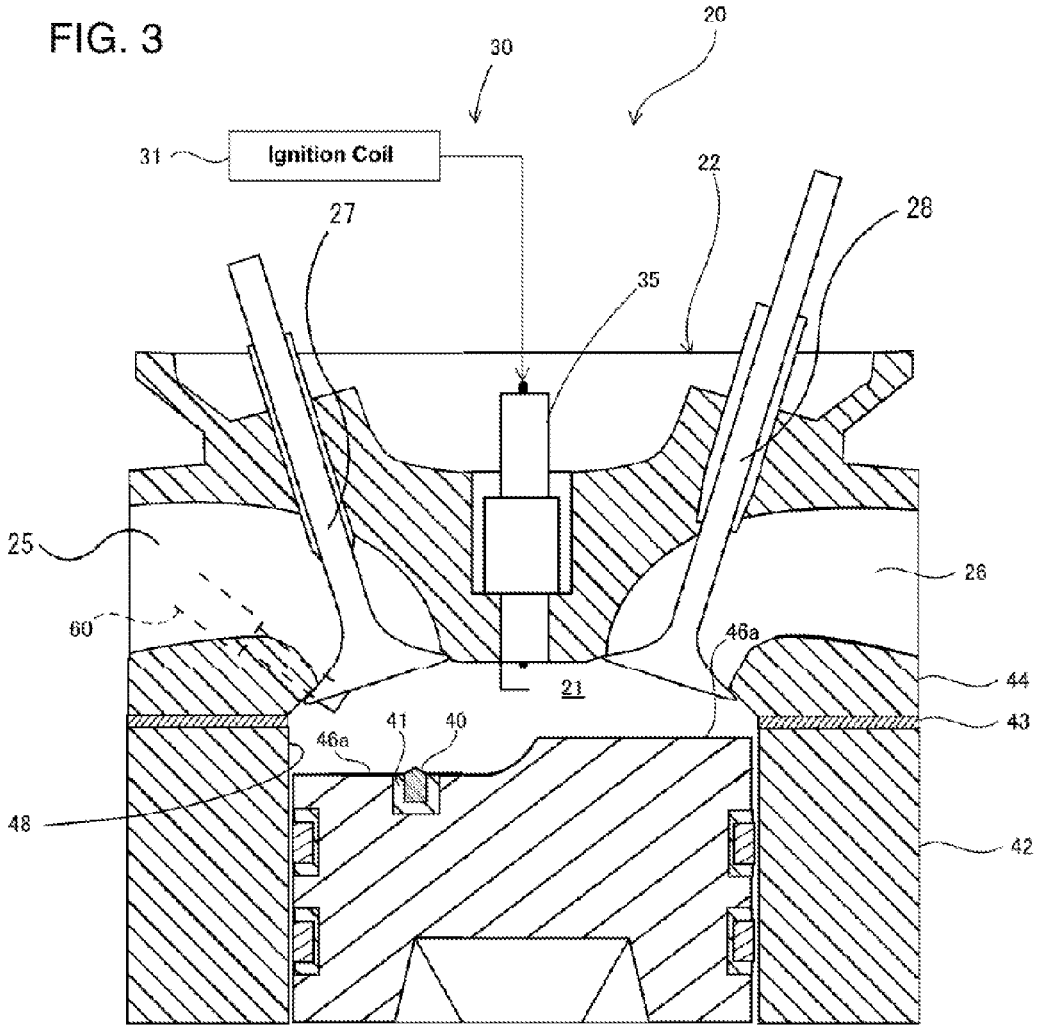
FIG. 3 is a longitudinal sectional view of an internal combustion engine according to a second embodiment.

The second embodiment is directed to an internal combustion engine 20 provided with a plasma generation device 30 according to the present invention. The plasma generation device 30 generates microwave plasma in a combustion chamber 21, which constitutes the target space. As shown in FIG. 3, the internal combustion engine 20 may be a direct gasoline injection engine. The internal combustion engine 20 is provided with an internal combustion engine main body 22, and the plasma generation device 30.

The internal combustion engine main body 22 includes a cylinder block 42, a cylinder head 44, and a piston 46. In the cylinder block 42, there are formed a plurality of cylinders 48 having circular cross-sections. Inside of each cylinder 48, the piston 46 is reciprocatably mounted. The piston 46 is connected to a crankshaft (not shown) via a connecting rod (not shown). The crankshaft is rotatably supported by the cylinder block 42. While the piston 46 reciprocates in each cylinder 48 in an axial direction of the cylinder 48, the connecting rod converts the reciprocation of the piston 46 to rotation of the crankshaft.

The cylinder head 44 is placed on the cylinder block 42, and a gasket 43 intervenes between the cylinder block 42 and the cylinder head 44. The cylinder head 44 partitions a combustion chamber 21 along with the cylinder 48 and the piston 46.

The cylinder head 44 is provided with one spark plug 35 for each cylinder 48. The spark plug 35 is fixed to the cylinder head 44 so that a discharge gap between a central electrode and a ground electrode locates within the combustion chamber 21. In the second embodiment, the spark plug 35 and an ignition coil 31 (corresponding to the pulse generator in the first embodiment) constitute a part of the plasma generation device 30.

The cylinder head 44 is formed with an intake port 25 and an exhaust port 26 for each cylinder 48. The intake port 25 is provided with an intake valve 27 for opening and closing the intake port 25. On the other hand, the exhaust port 26 is provided with an exhaust valve 28 for opening and closing the exhaust port 26.

The cylinder head 44 is provided with one injector 60 for each cylinder 48. The injector 60 protrudes toward the combustion chamber 21 from between two openings of the intake port 25. The injector 60 injects fuel from a plurality (three in the second embodiment) of Injection holes 55 toward directions different from one another. The injector 60 injects fuel toward a top surface of the piston 46.

Figure 4:
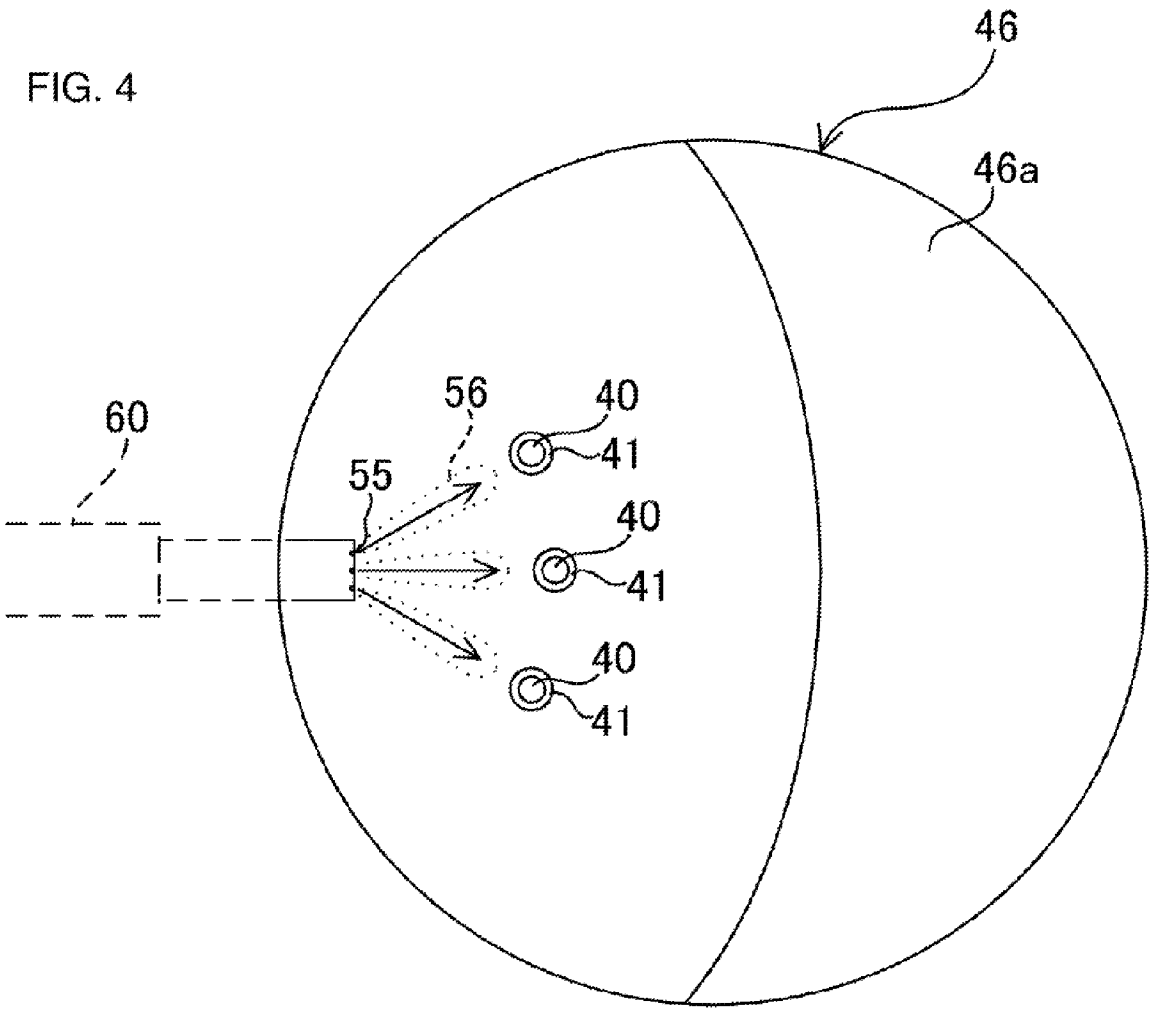
FIG. 4 is a top view of a piston of the internal combustion engine according to the second embodiment.

As shown in FIG. 4, the piston 46 is provided with the electric field concentration members 40 on a surface exposed toward the combustion chamber 21. The electric field concentration members 40 are the same in number as the injection holes 55 of the injector 60. The electric field concentration members 40 are electrically insulated from the piston 46 by respective insulating members 41. The electric field concentration members 40 protrude from the top surface of the piston 46. The electric field concentration members 40 are arranged respectively corresponding to the injection holes 55 of the injector 60. More particularly, viewing the top surface of the piston 46 from above, each electric field concentration member 40 is disposed at a location where a jet flow 56 injected from the injection hole 55 passes through.

In the second embodiment, when fuel is injected from the injection holes 55 of the injector 60, the control device 10 outputs a discharge signal to the ignition coil 31 and an electromagnetic wave generation signal to the power supply for electromagnetic wave 32 at the same time. As a result of this, similarly to the modified example of the first embodiment, strong electric fields, which have relatively strong electric field intensity in the combustion chamber 21, are formed in the vicinity of a tip end of the central electrode, which functions as the antenna 36, and in the vicinity of tip ends of electric field concentration members 40. The microwave plasma is generated in each strong electric field. The microwave pulse is outputted until the jet flow 56 injected from each injection hole 55 of the injector 60 has passed through the tip end of the electric field concentration member 40, and the microwave plasma is maintained until the microwave pulse output is terminated.

Effect of Second Embodiment

In the second embodiment, since the electric field concentration members 40 are arranged at locations respectively corresponding to the injection holes 55 of the injector 60, the microwave plasma is generated at locations respectively corresponding to the injection holes 55. Therefore, it is possible to cause the fuel injected from each injection hole 55 to effectively contact with the microwave plasma. Accordingly, it is possible to promote oxidation reaction of the fuel injected from each injection hole 55 and promote combustion.

Modified Example of Second Embodiment

In a modified example of the second embodiment, the internal combustion engine 20 is a diesel engine. The injector 60 is provided at a center of a ceiling surface of the combustion chamber 21. On the ceiling surface, a discharger 35 is mounted adjacent to the injector 60 (not shown).

Figure 5:
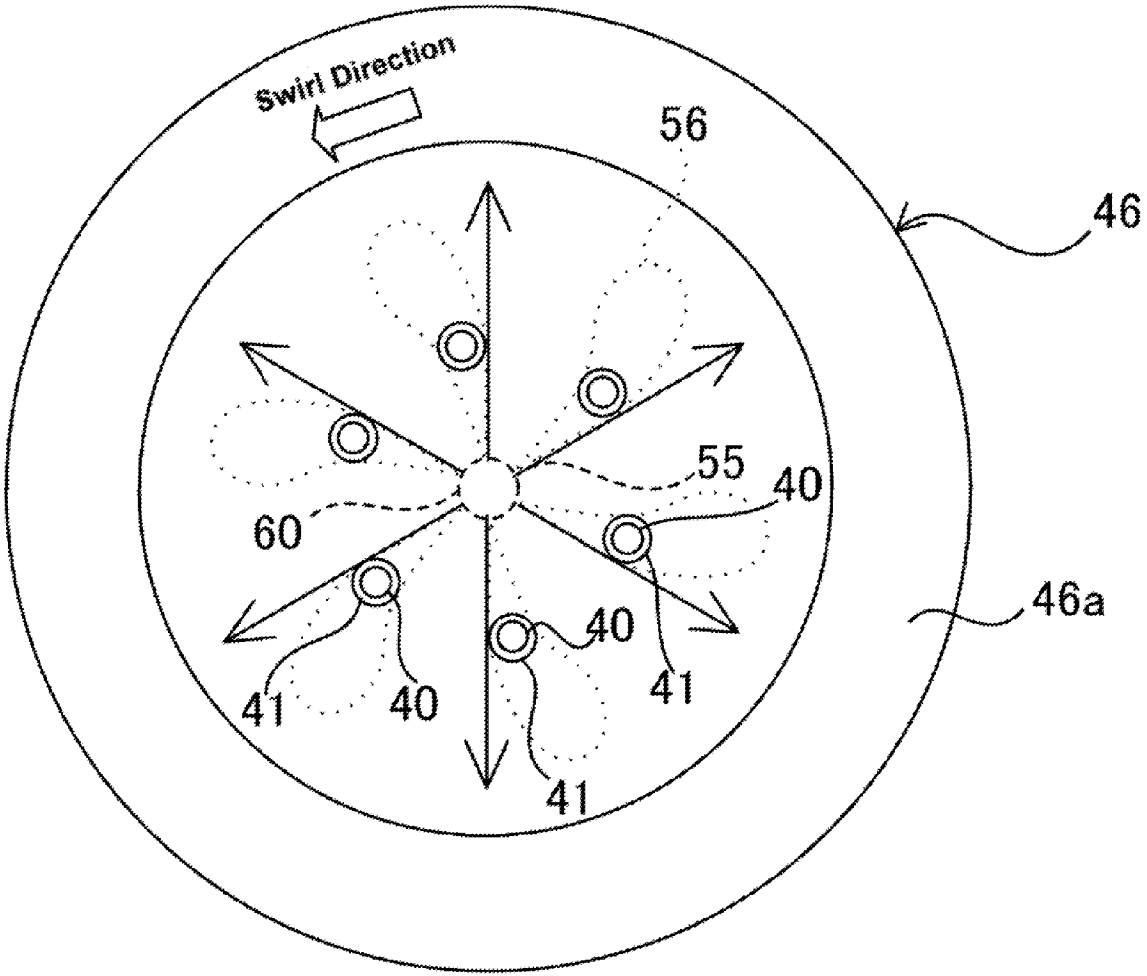
FIG. 5 is a top view of a piston of an internal combustion engine according to a modified example of the second embodiment.

As shown in FIG. 5, viewing the top surface of the piston 46 from above, each electric field concentration member 40 is disposed at a location where a jet flow 56 injected from each injection hole 55 passes through. In the present modified example, the internal combustion engine 20 is configured so that airflow swirls. Therefore, each electric field concentration member 40 is disposed at a location shifted in a swirl direction from a line extending straight from each injection hole 55 of the injector 60 in an injection direction.

In the present modified example, when fuel is injected from each injection hole 55 of the injector 60, the control device 10 outputs a discharge signal to the ignition coil 31 and an electromagnetic wave generation signal to the power supply for electromagnetic wave 32. As a result of this, similarly to the modified example of the first embodiment, strong electric fields, which have relatively strong electric field intensity in the combustion chamber 21, are formed in the vicinity of a tip end of the central electrode, which functions as the antenna 36, and in the vicinity of tip ends of the electric field concentration members 40. The microwave plasma is generated in each strong electric field. The microwave pulse is outputted until the jet flow 56 injected from each injection hole 55 of the injector 60 has passed through the tip end of the antenna 36, and the microwave plasma is maintained until the microwave pulse output is terminated.

Other Embodiments

The above described embodiments may also be configured as follows.

In the embodiments described above, the electron discharge unit may be configured so as to discharge thermal electrons (free electrons) by heating metal. As the electron discharge unit, a glow plug may be employed. In the second embodiment, a glow plug in a sub combustion chamber may be employed as the electron discharge unit. In this case, the main combustion chamber in the cylinder 48 and the sub combustion chamber held in communication with the main combustion chamber constitute the target space.

Furthermore, in the embodiments described above, the plasma generation device 30 may be configured so as to be switchable between a first state, in which the microwave plasma is generated in the vicinity of the antenna 36 and in the vicinity of the electric field concentration members 40, and a second state, in which the microwave plasma is generated only in the vicinity of the antenna 36 by lowering the energy per unit time of the microwave generated by the electromagnetic wave generator 33 in comparison with the first state.

INDUSTRIAL APPLICABILITY

The present invention is useful in relation to a plasma generation device that generates electromagnetic wave plasma by emitting electromagnetic waves in a target space.

EXPLANATION OF REFERENCE NUMERALS

30 Plasma Generation Device

33 Electromagnetic Wave Generator

35 Discharger (Electron Discharge Unit)

36 Antenna

40 Electric Field Concentration Member

51 Target Space

What is claimed is:

1. A plasma generation device, comprising:

a reaction chamber forming member having a target space therein;

an electromagnetic wave generator that generates an electromagnetic wave;

an antenna that emits the electromagnetic wave supplied from the electromagnetic wave generator in the target space;

an electron discharge unit that forcibly discharges free electrons in the target space; and an insulating member attached to the reaction chamber forming member;

an electric field concentration member attached to the insulating member which electrically insulates the electric field concentration member from the reaction chamber forming member without any electrical connection to other members of the plasma generation device, the electric field concentration member being arranged in non-contact relationship with the antenna in the target space so as to concentrate electric field of the electromagnetic wave emitted from the antenna, wherein the electron discharge unit forcibly discharges free electrons, and the antenna simultaneously emits the electromagnetic wave, thereby generating electromagnetic wave plasma in the vicinity of the antenna and in the vicinity of the electric field concentration member.

2. The plasma generation device according to claim 1, wherein the electric field concentration members are provided in plural so as to surround the antenna.

3. The plasma generation device according to claim 1, which is configured so as to be switchable between a first state, in which the electromagnetic wave plasma is generated in the vicinity of the antenna and in the vicinity of the electric field concentration member, and a second state, in which the electromagnetic wave plasma is generated only in the vicinity of the antenna by lowering energy per unit time of the electromagnetic wave generated by the electromagnetic wave generator in comparison with the first state.

4. An internal combustion engine, comprising:

the plasma generation device according to claim 1; and an internal combustion engine main body that is formed with a combustion chamber, wherein the plasma generation device generates the electromagnetic wave plasma in the combustion chamber as the target space.

5. The internal combustion engine according to claim 4, comprising:

an injector that includes a plurality of injection holes that inject fuel in directions different from one another, and injects fuel from the injection holes to the combustion chamber, wherein the electric field concentration members are provided in plural respectively corresponding to the plurality of injection holes of the injector and arranged at locations respectively corresponding to the injection holes.

6. The plasma generation device according to claim 2, which is configured so as to be switchable between a first state, in which the electromagnetic wave plasma is generated in the vicinity of the antenna and in the vicinity of the electric field concentration member, and a second state, in which the electromagnetic wave plasma is generated only in the vicinity of the antenna by lowering energy per unit time of the electromagnetic wave generated by the electromagnetic wave generator in comparison with the first state.

7. An internal combustion engine, comprising:

the plasma generation device according to claim 2; and an internal combustion engine main body that is formed with a combustion chamber, wherein the plasma generation device generates the electromagnetic wave plasma in the combustion chamber as the target space.

8. An internal combustion engine, comprising:

the plasma generation device according to claim 3; and an internal combustion engine main body that is formed with a combustion chamber, wherein the plasma generation device generates the electromagnetic wave plasma in the combustion chamber as the target space.

9. The internal combustion engine according to claim 4, further comprising a piston reciprocatably mounted in the internal combustion engine main body, wherein the electric field concentration member is located at a surface of the piston.

10. The internal combustion engine according to claim 7, further comprising a piston reciprocatably mounted in the internal combustion engine main body, wherein the electric field concentration member is located at a surface of the piston.

11. The internal combustion engine according to claim 8, further comprising a piston reciprocatably mounted in the internal combustion engine main body, wherein the electric field concentration member is located at a surface of the piston.

* * * * *